United States Patent [19]

Schwellinger et al.

[11] 4,241,889

[45] Dec. 30, 1980

[54] METHOD FOR INCREASING THE HIT PROBABILITY OF JAMMED MISSILES AND DEVICE FOR CARRYING OUT THE METHOD

[75] Inventors: Ulrich Schwellinger, Herzog-Siegmund-Weg, Zorneding; Rüdiger Lenz, Holzkirchen, both of Fed. Rep. of Germany

[73] Assignee: Messerschmitt-Bolkow-Blohm GmbH, Munich, Fed. Rep. of Germany

[21] Appl. No.: 933,795

[22] Filed: Aug. 15, 1978

[30] Foreign Application Priority Data

Aug. 26, 1977 [DE] Fed. Rep. of Germany ..... 2738507

[51] Int. Cl.[3] ..... F41G 7/00; F42B 15/02; G06F 15/50

[52] U.S. Cl. ..... 244/3.15; 244/3.19; 343/18 E

[58] Field of Search ..... 244/3.15, 3.19; 343/18 E

[56] References Cited

U.S. PATENT DOCUMENTS 4,160,974 7/1979 Stavis ..... 244/3.19

*Primary Examiner*—Theodore M. Blum

*Attorney, Agent, or Firm*—Toren, McGeady and Stanger

[57] ABSTRACT

A method and device is disclosed for increasing the hit probability of guided missiles exposed to jamming by double or multiple targets. In particular, the missiles are guided by the proportional navigation principle and have a follow-up target-seeking head. With the addition of a plurality of tracking filters, means for performing data analysis and means for performing data control to a conventional missile guidance system, signals from the target-seeking head or the missile may be analyzed to provide recognition of double or multiple target situations. Once recognition of the double or multiple target situation is made, the flow of data for controlling the guidance and target-seeking head follow is corrected to keep the missile permanently on the target.

9 Claims, 7 Drawing Figures

Fig.4b
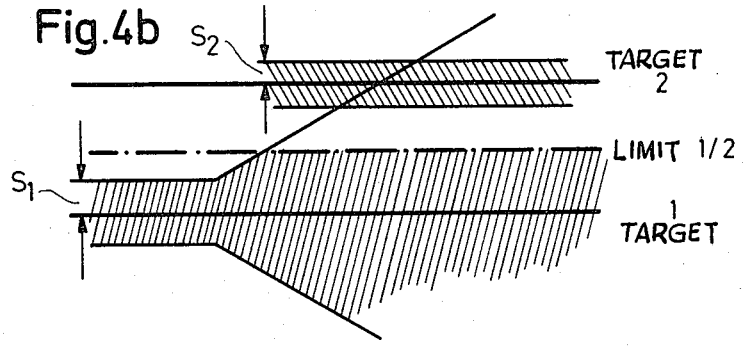
Fig.4c
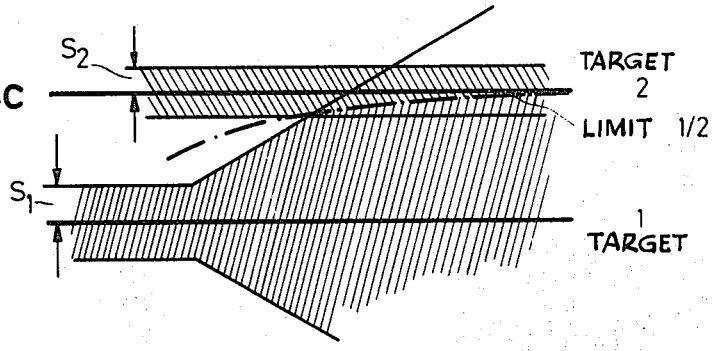
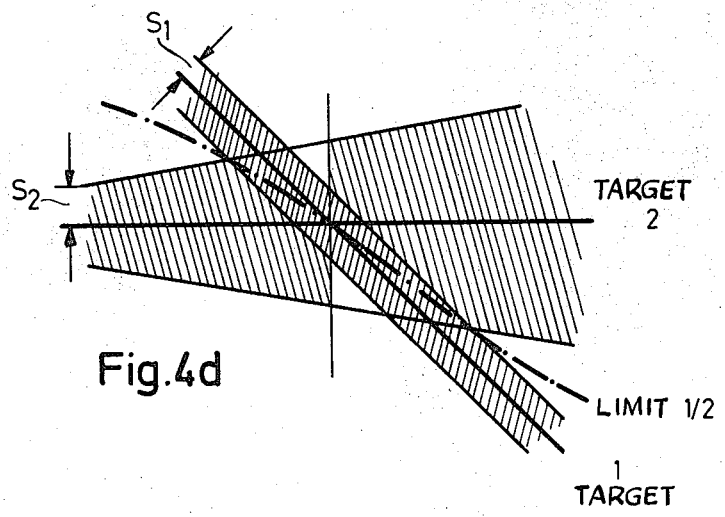
Fig.4d

METHOD FOR INCREASING THE HIT PROBABILITY OF JAMMED MISSILES AND DEVICE FOR CARRYING OUT THE METHOD

FIELD OF THE INVENTION

The invention relates to a method for increasing the hit probability of missiles exposed to jamming by double or multiple targets and which are guided preferably by means of proportional navigation and have a follow-up target-seeking head, and to a device for carrying out the method.

BACKGROUND OF THE INVENTION

In conventional missile guidance systems, the possibility is known wherein the guidance system may be jammed by counter-measures in such a manner that the mission of the missile can no longer be carried out successfully. In this connection, conventional guidance systems are understood to be those systems which consist of control loops or circuits for one or several guidance phases and which, beyond controlling the phase shift, initiating, etc., are not capable of performing logical decisions and switching procedures. Also belonging to this group are target seeking heads which are able to shift between an active phase and "home on jam", but which are otherwise able to perform tracking during guidance only and which do not have signal analysis, for example, capable of handling multiple targets. The mere existence of double or multiple targets may lead to a failure of the mission. The target seeking head guides the missile to points between the targets or instead, in most cases, past the targets. If, furthermore, the targets are able to transmit alternating jamming radiation and to induce the target seeking head to periodically change the target, as a rule, a failure of the mission will occur due to a small hit probability.

It is an object of the present invention to specify a method according to which it is possible to further pursue a target once it is recognized by the target-seeking head until it reaches the point of impact, without the existence of additional, and alternating, jamming targets influencing the hit probability of the missile; and to specify a device for carrying out the method.

BRIEF SUMMARY OF THE INVENTION

The solution in accordance with the invention is achieved in that the measured values of the first target recognized by the target-seeking head is assigned to a first evaluating filter by data control/data analysis means for the formation of a target track as well as for guidance and target-seeking head follow-up; that the filter is separated from the measured values of the target-seeking head if the measured values lead to the assumption that there is a movement of the line of sight which measured values must have been caused by a target maneuver which is unrealistic due to the maneuvering capability of airborne targets; that, in the filter, after separation by extrapolation of the measured values which had thus far been received, the probable target track is continued to be formed and the guidance of the missile and the target-seeking head follow-up are influenced accordingly; that, upon separation of the first filter, the additionally received measured values for the formation of the target track for the second target are fed into the next filter; that the first filter, upon separation of the second filter, is once again provided with measured values by the target-seeking head if these measured values are recognized by the data control/-data analysis to belong to that target track which is to be processed by the first filter; and that those measured values which are recognized to belong to no target track are not further processed.

For a better understanding of the present invention together with other and further objects thereof, reference is made to the accompanying drawings and following description while the scope of the invention will be pointed out in the appended claims.

BRIEF DESCRIPTION OF THE DRAWINGS

Referring to the drawings:

FIGS. 4*a*, 4*b*, 4*c* and 4*d* are graphical representations of examples for designing the ranges of tolerance of the filters.

DESCRIPTION OF THE PREFERRED EMBODIMENTS

Figure 1:
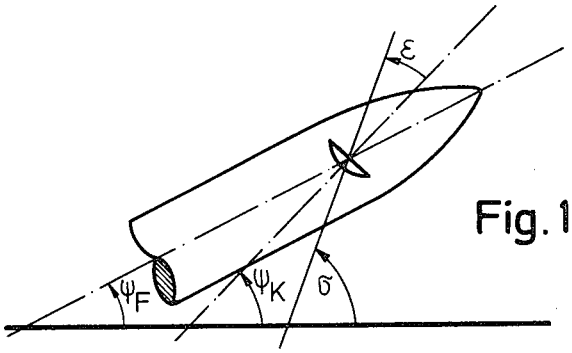
FIG. 1 shows the notations for various angles relating to a missile under consideration.

Referring initially to FIG. 1, the following angles are to be considered:

$\sigma$: Angle between line of sight and the reference direction;

$\psi_K$- Antenna direction relative to the reference direction;

$\psi_F$: Angle between longitudinal axis of the missile and reference direction;

$\epsilon$: Angle between line of sight and antenna direction.

Figure 2:
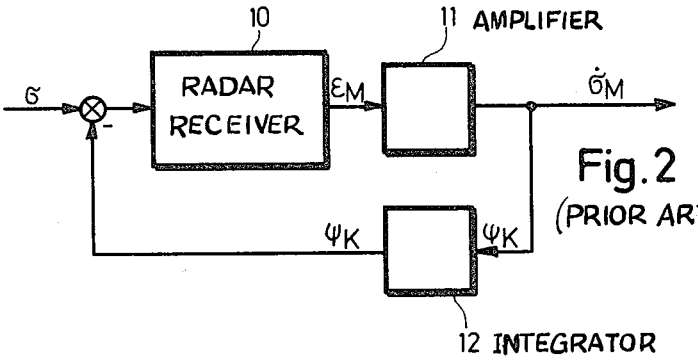
Fig. 2 (PRIOR ART)
FIG. 2 shows a simplified block diagram for a conventional target-seeking head, follow-up control loop.

The simplified block diagram for a conventional follow-up control loop according to FIG. 2 shows a radar receiver 10, an amplifier 11 and an integrator 12. The radar component measures the angle $\epsilon$ between antenna direction $\psi_K$ and the direction of the radiation source $\sigma$ (line of sight). The follow-up control loop causes the antenna axis to follow the line of sight and delivers to the guidance control system a measured value $\dot{\sigma}_M$ for the angular velocity of the line of sight. Assuming a correctly operating follow-up of the antenna to the line of sight, the angular velocity of the antenna $\dot{\psi}_K$ can be used as a measured value for the angular velocity of the line of sight $\dot{\sigma}$.

If the target-seeking head pursues two alternatingly jamming targets by means of "home-on-jam", it will alternately jump back and forth between the target directions $\sigma_1$ and $\sigma_2$. However, in this case, in the guidance control system, the angular movement of the target-seeking head is misinterpreted as an angular movement of the line of sight. On the basis of the law of guidance for proportional navigation $$\dot{\xi}=k\cdot\dot{\sigma}$$

with k as navigation constant (k=6 in counterfire), the missile performs k-times the change of flight direction $\dot{\xi}$ relative to the change of direction $\dot{\sigma}$ of the target-seeking head. The missile follows a wave line-shaped trajectory, whereby the amplitudes increase progressively during the approach toward the targets. As a rule, the missile will fly past and beyond the targets by a large distance. If the frequency of the target shift is so high that the missile and/or also the target-seeking head are no longer able to follow the target shifts the full amplitude, the missile will usually fly between the two targets.

Figure 3:
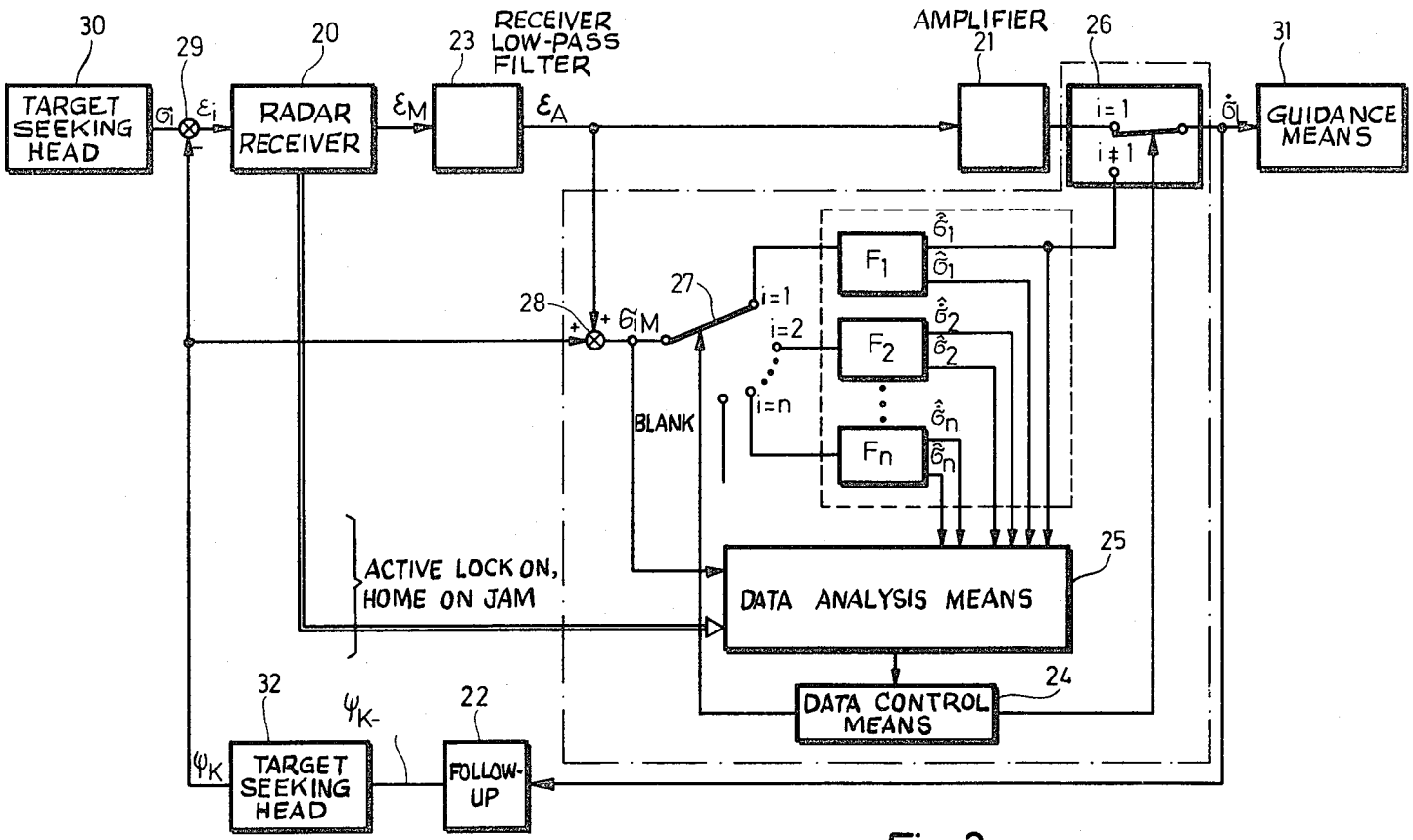
FIG. 3 illustrates a block diagram for a guidance system according to the invention.

FIG. 3 shows the block diagram of a system which is able, without difficulty, to handle multiple targets and the situation of alternatingly jamming multiple targets and which is able to ensure to an excellent degree the success of the mission of the missile. For a better understanding, the description is made under the assumption that the movement takes place in a plane, with the transposition into 3-dimensional space being trivial.

To the conventional system shown in FIG. 2, there have essentially been added tracking filters $F_1$ to $F_n$, means for performing data analysis 25 and means for performing data control 24. As shall be explained in detail hereinafter, the data analysis means 25 provides a critical analysis of the signals from the target-seeking head or the missile and is supposed to recognize double or multiple target situations. The data control means 24 intervenes in the conventional guidance system and controls the flow of data for guidance and target-seeking head follow-up in such a manner that the missile is kept permanently on the target.

As the block diagram shows, the value $\epsilon_M$ is formed by a radar receiver 20. From this value $\epsilon_M$, the value $\epsilon_A$ is filtered out in a receiver low-pass filter 23. These values are now used for the formation of a track for the measured values from the target-seeking head. However, it is also possible to use other data available in the radar receiver, such as, for example, the received energy, information about frequency and modulation of the received signal, as supplemental information in the data analysis means 25. Accordingly, it can generally be started from a measured vector which characterizes a measurement according to various aspects and eliminates ambiguities in some of the elements of the vector.

The value $\epsilon_A$ reaches the filter $F_1$ through a summation point 28 and a switch 27; accordingly, the course of the target 1 is pursued by the filter 1.

A value $\psi_K+\epsilon_A$ formed at the summation point 28 reaches the data analysis means 25. This value $\psi_K+\epsilon_A$ is compared to the value $\hat{\sigma}$ which is formed in the filter by extrapolation for this point in time. If the value lies within a certain range of tolerance, the measured value is used for the formation of a new estimated value. On the other hand, if the measured value lies outside of the tolerance, it is refused since it must be assumed that the value comes either from another target (jamming at this point in time) or that the measured value is an aberration so that it will be put or assigned to the switch position BLANK.

If the targets are jamming alternatingly, the filter must extrapolate the course of the target over longer periods of time as long as no additional measured values are received.

However, since in the meantime, extrapolation mistakes may have occurred in the filter by target maneuvers or missile maneuvers, and to once again catch the target, the range of tolerance about the estimated target course is enlarged as the uncertainty in extrapolation increases. For this purpose, it is sufficient to perform a linear enlargement. Of course, depending on the desired hit probability, also an enlargement can be provided for which is exponential or parabolic, etc. Once the range of tolerance is enlarged and usable target information is again received, the range of tolerance is exponentially reduced to its minimum value.

Figure 4A:
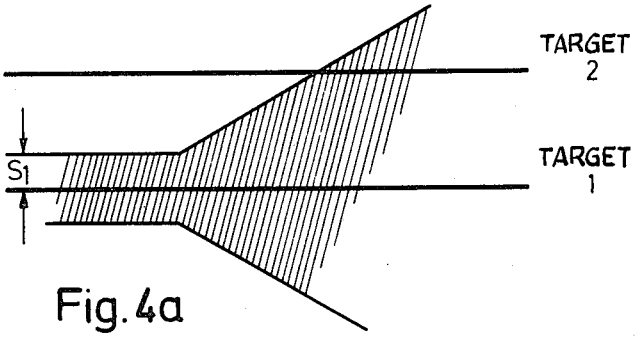

However, with increasing extrapolation time, there is the increased danger that also measured values from jamming targets fit into the range of tolerance and are therefore no longer refused. The result would be an abrupt target shift in the filter which brings about such strong guidance commands that the missile loses both targets (FIG. 4*a*).

For this reason, for any additional target, another tracking filter is assigned so that a high certainty in the assignment of measured values to the individual targets is achieved. The estimated value $\hat{\sigma}_2$ formed by the next filter is used in such a way that the incoming measured values can be better assigned to a certain target. This principle can generally be expanded to n filters for n targets.

The filter 1 forms, in the extrapolation phases, also the estimated value $\hat{\sigma}_1$ for guidance and target-seeking head follow-up. These values are made available through the switch 26 for guidance and target-seeking head follow-up, when the filter is in the extrapolation phase. For this purpose, the data control 24 actuates the switch from $i=1$ to the position $i\neq 1$.

For example, the assignment of measured values can be performed according to the formula:

$$|y-\hat{\sigma}_1|<|y-\hat{\sigma}_2|$$

i.e., a measured value y is assigned to the filter 1 if it corresponds to the condition and is used in the filter for correction or is refused.

FIG. 4*b* shows this relationship for two targets. The filter 1 for target 1 is extrapolating at the present time, while filter 2 is receiving measured values and, if necessary, uses them for correction.

However, a measured value can also be offered to that filter to which it belongs with a highest probability (FIG. 4*c*).

If $$\frac{|\sigma_M-\hat{\sigma}_1|}{S_1}<\frac{|\sigma_M-\hat{\sigma}_2|}{S_2}$$

the measured value reaches filter 1, in the reverse case it reaches filter 2. The catching range has now significantly widened in favor of that filter which extrapolates at the moment. The region in which the extrapolating filter 1 is able to take away measured values from filter 2 is limited to at most 50% of the range $S_2$ of filter 2 (for $S_1=\infty$ i.e. $t\rightarrow\infty$).

The case of a crossing (FIG. 4*d*) deserves a special consideration, that is, if there is a true crossing, or if the estimated courses of the two targets cross due to an extrapolation mistake in a filter, or, instead, if a crossing is simulated by the discriminator characteristic of the target-seeking head. In this case, the catching range of the filter 2 which is extrapolating at the moment is limited in such a manner that the range of tolerance $S_1$ of filter 1 is not curtailed. For this purpose, a measured value is first offered to that filter which, due to the small range of tolerance, has also thus far received the measured values, However, since this measure simultaneously impedes the separation of targets in the case of closely adjacent targets, an additional limitation is introduced so that only those cases are considered in which a crossing of the courses can be expected within a predetermined period of time (for example, 0.5 seconds).

Accordingly, it results that the filter $F_1$ is initiated as soon as several consecutive measured values form a continuous track. In this case, the switch 26, also, is switched from the position $i=1$ to $i \neq 1$ through the data control means 24, so that guidance 31 and target-seeking head follow-up 22, 32 are supplied by filter 1. If measured values are refused because they do not fit into the range of tolerance $S_1$ belonging to filter 1, it is evaluated in the data analysis 25 whether these measured values once again form a track and, if necessary, another filter is initiated, and so forth.

It is sufficient to use as filters fading memory filters as described in N. Morrison "Introduction to Sequential Smoothing and Prediction", McGraw-Hill Book Company, 1969, with the modification of "Extrapolation". The use of other types of filters is conceivable (for example, Kalman-Filters); however, the resulting greater expenditure is not justified since a hit probability of more than 95% is achieved by fading memory filters.

Moreover, fading memory filters offer the advantage that they weight new measured values more strongly than older measured values and are, therefore, able to satisfactorily follow a chronological sequence even in the case of a low polynomial function.

While it is believed that the means for performing data analysis 25 and the means for performing data control 24 would be readily apparent to one of ordinary skill in the art, a circuit such as that shown in SBP 9900 Texas Instruments may be used for data analysis means 25 and a circuit such as that shown in SBP 9900 Texas Instruments may be used for data control means 24.

As has been described above, in the majority of all cases, the target which is recognized first is maintained. That is, the recognizing capability of the target-seeking head is designed in such a way that a target shift is recognized as such and is refused without losing the originally recognized target.

According to the invention, it is possible to increase the hit probability to almost 95% as compared to just under 16% in conventional guidance systems. The method enables the missile to become insensitive to any chosen number of jamming targets without the method itself being changed. Thus, depending on the predetermined mission of the missile, an adjustment can be carried out by choosing the number of filters without having to carry out changes at the missile itself. Consequently, even existing missiles can be equipped without difficulty with a device according to the invention. Extensive tests have shown, according to another goal of the invention, that it is almost of no importance to the method whether the targets maneuver or not.

While the foregoing description and drawings represent the preferred embodiments of the present invention, it will be obvious to those skilled in the art that various changes and modifications may be made therein without departing from the true spirit and scope of the present invention.

We claim:

1. A method for increasing the hit probability of missiles which are subject to being jammed by double or multiple targets and which missiles are guided by means of proportional navigation and have a target-seeking head capable of following up comprising the steps of:

assigning measured values $\sigma_{iM}$ of a first target recognized by the target-seeking head of the missile to a first filter, $F_1$, for target track formation as well as for guidance and target-seeking head follow-up;

separating the first filter from the measured values $\sigma_{iM}$ of the target-seeking head if the measured values result in a determination that there is movement of the line of sight of the missile, which measured values must have been caused by a target maneuver which is outside of predetermined limits because of the maneuverability of airborne targets;

continuing to form by extrapolation in said first filter the probable target track after said filter has been separated and influencing the guidance of said missile and target-seeking head with said probable target track;

supplying, after separation of said first filter, measured values of target track information from a second target to a second filter $F_2$;

separating the second filter and again providing the first filter with measured values by the target-seeking head when the measured values are recognized to belong to the target track processed by the first filter; and recognizing measured values belonging to no target track and not processing such measured values.

2. A method according to claim 1, including the step of supplying the measured values $\sigma_{iM}$ corresponding to any number of additional targets to a corresponding number of filters $F_2 \ldots F_n$.

3. A method according to claims 1 and 2, including assigning to each filter $F_1 \ldots F_n$, a predetermined range of tolerance of recognition $S_1 \ldots S_n$, said filters accepting or refusing assigned measured values accordingly.

4. A method according to claim 3, including the widening of the range of tolerance $S_1 \ldots S_n$ of said filters $F_1 \ldots F_n$ when said filters extrapolate.

5. A method according to claim 4, wherein the widening of the range of tolerance is performed in a linear manner.

6. A method according to claims 3 and 4, wherein measured values $\sigma_{iM}$ are once again received by said filters $F_1 \ldots F_n$, reducing said range of tolerance to its nominal value $S_1 \ldots S_n$ in an exponential manner.

7. A method according to claim 2, wherein in case of conflict, i.e., when measured values fit into the range of tolerance of two or more filters, offering said measured values to that filter to which they are closest in relation to the tolerance limit.

8. A method according to claim 2, wherein in the case a crossing of target tracks has been recognized, offering said measured values only to that filter which also thus far has received said measured values.

9. In a missile guided by means of a proportional navigation control system and having a target-seeking head capable of following up, the improvement comprising:

at least two filters;

first switching means for supplying measured values $\sigma_{iM}$ to said filters;

means for performing data analysis of signals from the target-seeking head and from the missile and responsive to said filters;

means for performing data control for providing correction signals to the guidance control system of the missile in response to the data analysis performing means;

said first switching means supplying measured values $\sigma_{iM}$ of a first target recognized by the target-seeking head to a first filter $F_1$, upon being assigned to said first filter by said data analysis means and said data control means, for target track formation as well as for guidance and target-seeking head follow-up;

said switching means switching away from said first filter if said data analysis means determines that analysis of the measured values $\sigma_{iM}$ results in a determination that there is movement of the line of sight of the missile which measured values must have been caused by a target maneuver which is outside of predetermined limits because of the maneuverability of airborne targets;

said first filter continuing, after being switched away from by said switching means, by extrapolation of measured values previously received before switching, to form the probable target track, said first filter having an output which is coupled to the guidance system of the missile during extrapolation;

a second switching means for supplying measured values to said guidance control system and target-seeking head follow-up during extrapolation by said first filter;

said second filter receiving further measured values for target track formation for a second target by way of said switching means after said switching means switches away from said first filter;

said data analysis means and data control means, after analyzing values passing through said second filter, determining that measured values again belong to those values to be processed by said first filter, said switching means responsive to this determination and again supplying measured values by said target-seeking head, after disconnecting from said second filter, said data analysis and data control means capable of recognizing those measured values which belong to no target track so that such measured values are not processed.

* * * * *